US012116867B1

(12) United States Patent
Mosscrop

(10) Patent No.: US 12,116,867 B1
(45) Date of Patent: Oct. 15, 2024

(54) SYSTEMS AND METHODS FOR PREVENTING HYDRATE FORMATION IN UNDERWATER EQUIPMENT

(71) Applicant: OneSubsea IP UK Limited, London (GB)

(72) Inventor: Guy Mosscrop, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/538,026

(22) Filed: Dec. 13, 2023

(51) Int. Cl.
*E21B 36/04* (2006.01)
*E21B 33/035* (2006.01)
*E21B 47/001* (2012.01)

(52) U.S. Cl.
CPC ..... *E21B 36/04* (2013.01); *E21B 33/0355* (2013.01); *E21B 47/001* (2020.05)

(58) Field of Classification Search
USPC ..... 166/336
See application file for complete search history.

(56) References Cited

U.S. PATENT DOCUMENTS

| | | | | |
|---|---|---|---|---|
| 6,564,011 | B1 * | 5/2003 | Janoff | F16L 53/38 392/479 |
| 6,617,556 | B1 * | 9/2003 | Wedel | E21B 43/01 219/661 |
| 6,776,227 | B2 * | 8/2004 | Beida | E21B 36/006 166/57 |
| 7,036,596 | B2 * | 5/2006 | Reid | F16L 53/32 165/45 |
| 7,568,526 | B2 * | 8/2009 | de St. Remey | E21B 43/2401 166/61 |
| 7,669,659 | B1 * | 3/2010 | Lugo | E21B 36/04 166/61 |
| 8,424,608 | B1 * | 4/2013 | Lugo | E21B 36/005 166/57 |
| 9,062,808 | B2 * | 6/2015 | Hyde | F28D 7/106 |
| 9,253,821 | B2 * | 2/2016 | Bremnes | E21B 36/04 |
| 2018/0058166 | A1 * | 3/2018 | Maher | E21B 43/01 |
| 2023/0108320 | A1 * | 4/2023 | Moe | E21B 41/0007 |

* cited by examiner

*Primary Examiner* — Matthew R Buck
*Assistant Examiner* — Douglas S Wood
(74) *Attorney, Agent, or Firm* — Jeffrey D. Frantz

(57) ABSTRACT

A system includes a subsea tree comprising an area susceptible to formation of hydrates when a shut-down of a well occurs. The system also includes a trace heating blanket comprising an exterior layer and an interior layer comprising electric coils, wherein the trace heating blanket is disposed about the area of the subsea tree susceptible to formation of hydrates.

20 Claims, 5 Drawing Sheets

SYSTEMS AND METHODS FOR PREVENTING HYDRATE FORMATION IN UNDERWATER EQUIPMENT

BACKGROUND

The present disclosure generally relates to systems and methods for prevention of hydrate formation in underwater equipment, such a well equipment for a subterranean oil and gas reservoir.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

In subsea applications, various types of infrastructure may be positioned along a sea floor including subsea trees. During operation of the infrastructure, there exists a temperature differential between the underwater equipment and ocean water. However, when a shut-down (either planned or unplanned) occurs at a well, the temperatures inside the underwater equipment begin to drop due to their exposure to the ocean water. This can cause the formation of gas hydrates.

Gas hydrates are crystalline water-based solids, with a crystalline structure comprised of water and hydrocarbon molecules (e.g., $CH_4$). These solids can be formed above the freezing temperature of water (e.g., 5° C.-15° C. or less) and these temperatures can be present in offshore drilling operations at the wellsite. Accumulation of these solids, especially in underwater equipment, can lead to stoppages (and their associated costs) until the gas hydrates can be removed to allow for proper functioning of the underwater equipment.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
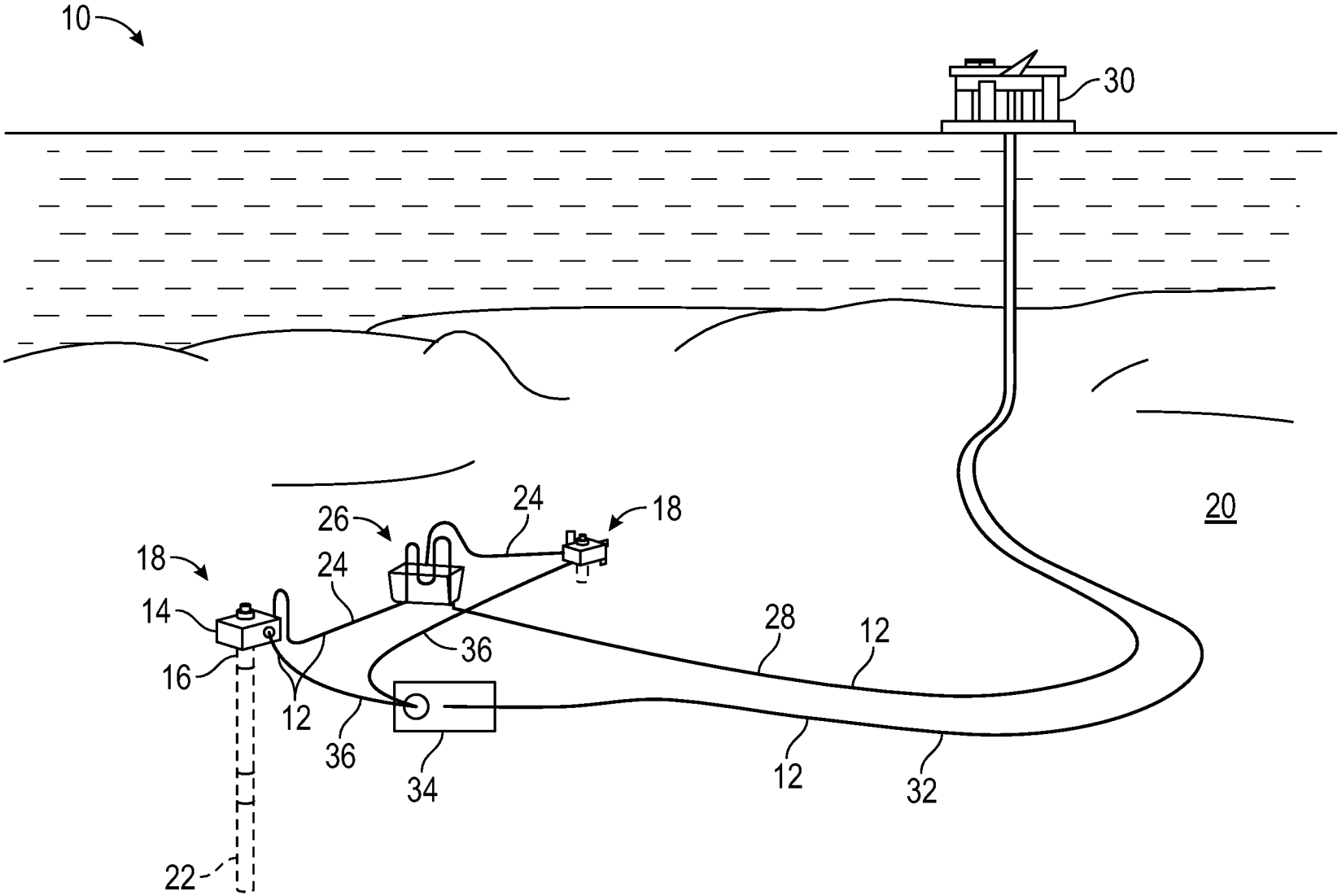
FIG. 1 is a schematic view of a subsea system having subsea equipment, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

The temperatures of ocean water surrounding offshore wells can reach, for example, near freezing temperatures (e.g., 5° C.-15° C. or less). Typically, during operation, underwater equipment, such as trees (e.g., subsea injection or production trees, etc.), manifolds (e.g., subsea injection or production manifolds), and/or substations (e.g., subsea boosting stations) of the well equipment are heated via the temperatures of the hydrocarbons passing therethrough. However, during shut-downs of a well (either planned or unplanned), hydrocarbons cease to flow through the underwater equipment. Moreover, some hydrocarbons may remain trapped in portions of the underwater equipment during the shut-down.

These trapped hydrocarbons drop in temperature (due to their proximity of the ocean water) as the length of the shut-down extends. This can cause the formation of gas hydrates, which are crystalline water-based solids, with a crystalline structure comprised of water and hydrocarbon molecules (e.g., $CH_4$). Formation of these hydrates as solids can lead to plugging issues and can slow (or even halt) the ability of the well to be reactivated upon conclusion of the shut-down. This can lead to costly operational delays.

Accordingly, in some embodiments, underwater equipment may be outfitted with trace heating blankets. The trace heating blankets can include coils (e.g., heating coils) and can be distributed around hydrate-vulnerable portions of underwater equipment. A controller can also be coupled to the trace heating blankets to control activation and deactivation of the trace heating blankets (e.g., activation and deactivation of the coils in the trace heating blankets). In this manner, the trace heating blankets can be selectively activated when needed (e.g., during a shut-down event) and selectively deactivated when not needed (e.g., during normal well operation). In this manner, the trace heating elements do not draw additional power when not needed.

As such, in certain embodiments, a heating system that can be selectively activated and deactivated is described. The heating system can include heating elements that are disposed on particular areas of undersea equipment where hydrates are known to form during shut-down events. The heating elements can be disposed about existing undersea equipment during manufacture of the underwater equipment, prior to installing of the undersea equipment, or subsequent to (or as part of) the installation of the undersea equipment (e.g., via a remotely operated vehicle).

With the foregoing in mind, FIG. 1 is a schematic view of a subsea system 10. The subsea system 10 located in the underwater location may include electrical cables 12 used for transmitting information and primary electrical power for various subsea components (e.g., actuators, sensors, etc.). The subsea system 10 may also include a subsea hydrocarbon production system configured to extract oil or gas from a subterranean reservoir, a subsea fluid injection system configured to inject fluid (e.g., liquid or gas) into a subterranean reservoir, or any other subsea system associated with subterranean reservoirs. In certain embodiments, the subsea system 10 may include a subsea tree 14 (e.g., tree, such as a Christmas tree) coupled to a wellhead 16 to form a subsea station 18 configured to extract and/or inject fluids relative to a subterranean reservoir. For example, the subsea station 18 may be configured to extract formation fluid, such as oil and/or natural gas, from the sea floor 20 through the subterranean well 22. In some embodiments, the subsea system 10 may include multiple subsea stations 18 that extract (and/or inject) fluids relative to respective subterranean wells 22.

In embodiments of the subsea system 10 configured for production, after passing through the subsea tree 14, the formation fluid flows through fluid conduits or pipes 24 to a pipeline manifold 26. The pipeline manifold 26 may connect to one or more flowlines 28 to enable the formation fluid to flow from the subterranean wells 22 to a surface platform 30. In some embodiments, the surface platform 30 may include a floating production, storage, and offloading unit (FPSO) or a shore-based facility. In addition to flowlines 28 that carry the formation fluid away from the subterranean wells 22, the subsea system 10 may include lines or conduits 32 that supply fluids, as well as carry control and data lines to the subsea equipment. These conduits 32 connect to a distribution module 34, which in turn couples to the subsea stations 18 via supply lines 36. In some scenarios, the surface platform 30 may be located a significant distance (e.g., greater than 100 m, greater than 1 km, greater than 10 km, or greater than 60 km) away from the subterranean wells 22. The subsea system 10 (e.g., the subsea tree 14, the subsea station 18, the pipeline manifold 26, and/or the distribution module 34) may include a subsea power system (e.g., subsea power bus system) that provides secondary power from energy storage units (e.g., batteries, fuel cells, or super capacitors (for initial actuator movement)) over one or more buses to various subsea components (e.g., actuators, sensors, etc.). For example, the subsea power system may be configured to provide secondary power, such as during a power loss from the primary power from the electrical cables 12, to operate various valves, sensors, and other subsea components. While the subsea system described above is for extracting hydrocarbons, it should be understood that the present disclosure may also apply to other types of subsea systems 10 such as subsea injection systems (e.g., subsea gas injection system, subsea water injection system, etc.).

Figure 2:
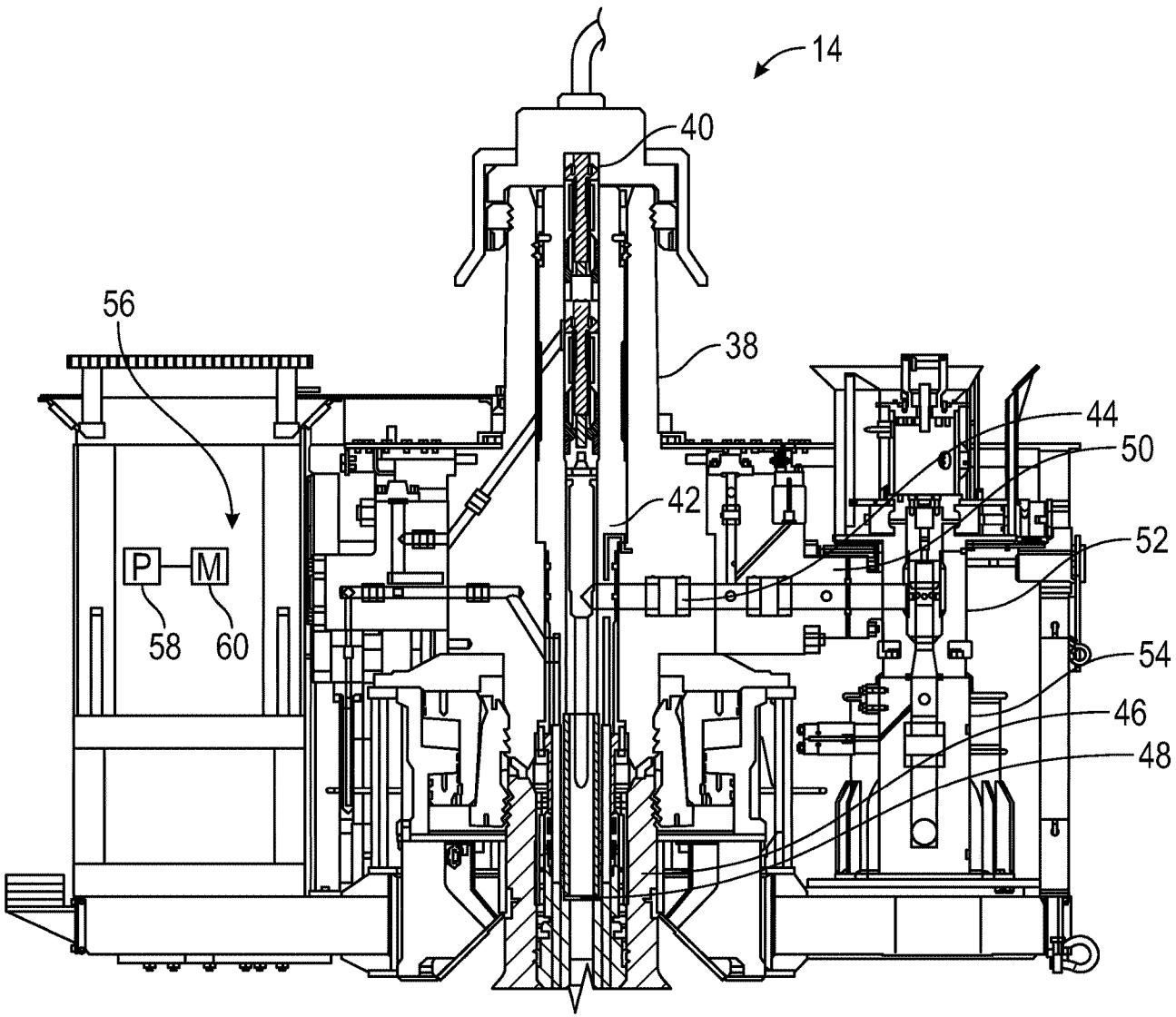
FIG. 2 is a block diagram of the subsea tree of FIG. 1, according to an embodiment of the present disclosure.

With the foregoing in mind, FIG. 2 is a schematic view of an embodiment the subsea tree 14 of FIG. 1. The subsea tree 14 is an example of underwater equipment in which hydrate formation can occur during, for example, shut-down events, such as planned maintenance, cleaning, and/or servicing of underwater portions of the subsea system 10, shut-in of the subterranean well 22 due to weather conditions or that can develop, shut-in of the well due to monitored conditions of the well (e.g., warning signs of kick), and/or other observed conditions that lead to shut-in of the subterranean well 22.

The subsea tree 14 includes a vertical flow path that passes through an upper region 38 of the subsea tree 14. This upper region 38 can include a spool body 40, which can operate to control flow from the wellbore and/or manage fluids or gas injected into the subterranean well 22. Additionally present in the subsea tree 14 is a tubing hanger 42, which can suspend tubing (i.e., a tubing string) of the subsea tree 14 and can additionally incorporate a sealing system (e.g., annular seal) to ensure isolation of, for example, a tubing conduit and annulus.

The subsea tree 14 also includes a master production valve 44 that operates to control all flow from the wellbore, for example, fluids transmitted from the wellhead 46 (e.g., a wellhead housing of the wellhead 46) via production tubing 48. Also illustrated is a production wing 50, which is an automatically actuated component that utilizes positive hydraulic pressure to remain open. The production wing 50 also prevents injection/flow to the subterranean well 22 under, for example, shut-down events. The production wing 50 is illustrated as being paired with a production choke 52 with a choke to control flow volume and pressure out of the subterranean well 22. The production choke 52 operates as the "tap" where hydrocarbons will flow from. A flowline isolation valve block 54 is additionally illustrated. The flowline isolation valve block can include an isolation valve that closes and isolates production from the subterranean well 22 and a flow line.

Additionally illustrated is a subsea control system 56. The subsea control system 56 may be any electronic data processing system that can be used to carry out the systems and methods of this disclosure. For example, the subsea control system 56 may include one or more processors 58, which may execute instructions stored in memory 60 (and/or storage). The memory 60 (and/or storage) of the subsea control system 56 may be any suitable article of manufacture that can store the instructions. In certain embodiments, the one or more processors 58 may include a microprocessor, a microcontroller, a processor module or subsystem, a programmable integrated circuit, a programmable gate array, a digital signal processor (DSP), or another control or computing device. In certain embodiments, the one or more processors 58 may include machine learning and/or artificial intelligence (AI) based processors.

In certain embodiments, the memory 60 (and/or storage) is implemented as one or more non-transitory computer-readable or machine-readable storage media. In certain embodiments, the memory 60 may include one or more different forms of memory, including semiconductor memory devices such as dynamic or static random access memories (DRAMs or SRAMs), erasable and programmable read-only memories (EPROMs), electrically crasable and programmable read-only memories (EEPROMs) and flash memories. The storage may include solid state drives or other types of long term storage devices. Note that the computer-executable instructions and associated data of the analysis module(s) may be provided on one computer-readable or machine-readable storage medium of the memory 60 or the storage, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the storage may be located either in the machine running the machine-readable instructions or may be located at a remote site from which machine-readable instructions may be downloaded over a network for execution.

As illustrated, the subsea control system 56 is a local component of the subsea tree 14. However, it can instead be at the surface (e.g., at the surface platform 30), at another location of the subsea station 18, or at another location (e.g., a remote data processing device located away from the subsea system 10. As will be described in greater detail below, in addition to control of operation of the subsea tree 14, in some embodiments the subsea control system 56 will also control operation of a heating system (e.g., one or more trace heating blankets as well as, for example, a power supply that transmits power to the one or more trace heating blankets) used in conjunction with the subsea tree 14. Alternatively, a second (dedicated) subsea control system 56 can instead be dedicated to the heating system that will be described below. Whether the illustrated subsea control system 56 or a dedicated subsea control system is used to control the heating system described below, the memory 60 can include instructions stored on the memory 60 and executable by the processor 58 to control operation of the heating system.

Figure 3:
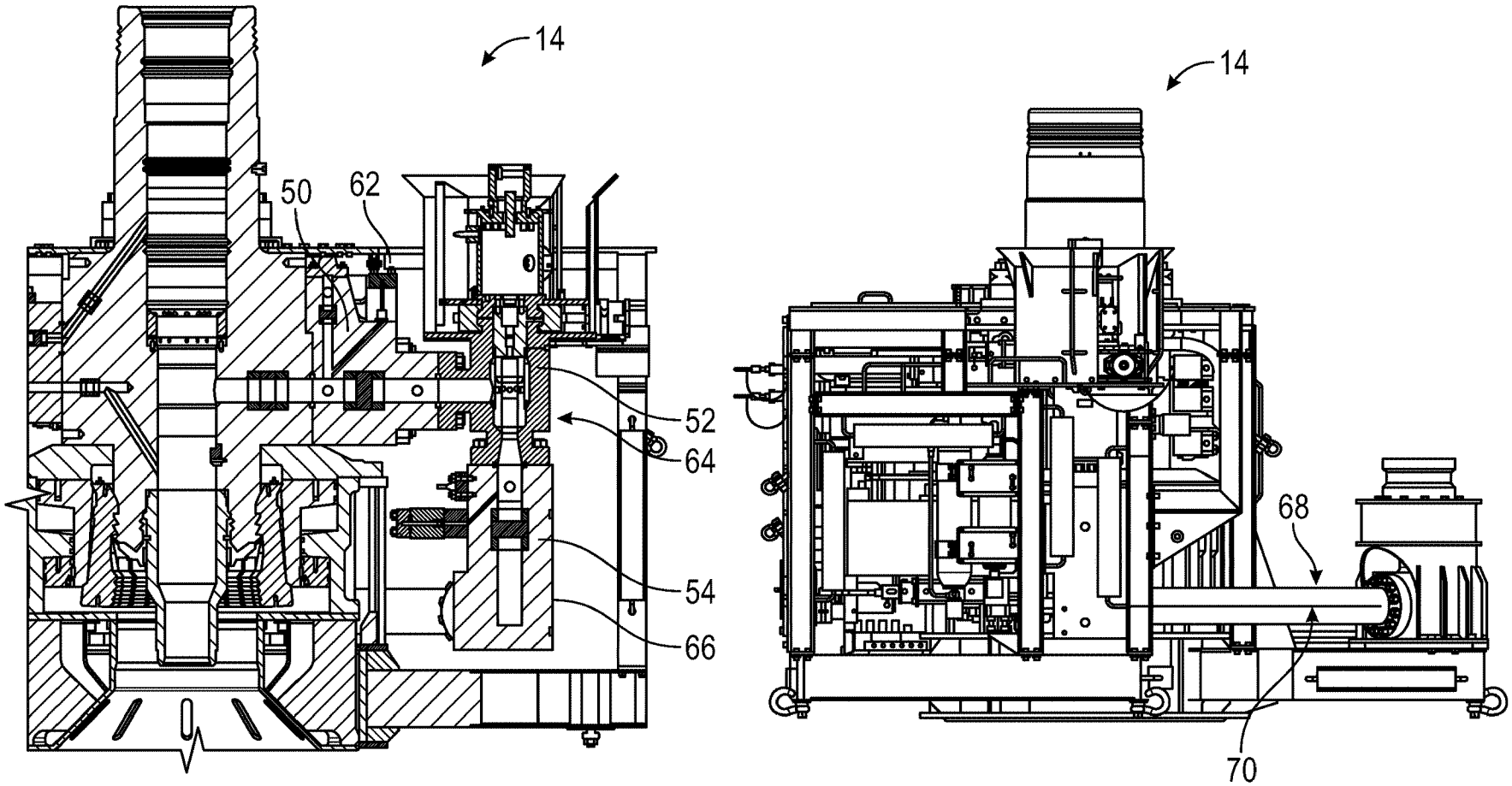
FIG. 3 illustrates a partial front view and a partial side view of the subsea tree of FIG. 2, according to an embodiment of the present disclosure.

As noted above, when the subsea tree 14 is not in operation (e.g., during a planned or an unplanned shut-down), hydrocarbons cease to flow through the subsea tree 14. Without the flow of hydrocarbons through the subsea tree 14, temperatures in the subsea tree 14 tend to drop (e.g., the bore temperature at shut-down is approximately 38° C.-120° C.) due to environmental factors (e.g., the temperature of the water surrounding the subsea tree 14, for example, (e.g., 5° C.-15° C. or less). This can lead to the formation of hydrates, especially at low points of process conduits, where liquids tend to gather. FIG. 3 illustrates a front view of the subsea tree 14 that illustrates region 62, region 64, and region 66 as examples of areas of the subsea tree 14 susceptible to formation of hydrates when a shut-down occurs. As illustrated, region 62 includes the production wing 50, region 64 includes the production choke 52, and region 66 includes the flowline isolation valve block 54. FIG. 3 additionally illustrates a side view of the subsea tree 14 that illustrates region 68 as another examples of an area of the subsea tree 14 susceptible to formation of hydrates when a shut-down occurs. As illustrated, region 68 includes a flowspool 70, which may be a pipe element that operates to connect the subsea tree 14 to, for example, pipes 24 or may itself be part of pipes 24.

If the localized low points (cold spots) described above, e.g., region 62, region 64, region 66, region 68, etc., can have their temperatures elevated by heating in these particular areas, then hydrate formation can be avoided. In some embodiments, heating coils (e.g., low power heating coils) can be distributed around the hydrate vulnerable elements of a subsea tree 14, e.g., region 62, region 64, region 66, region 68, etc. In the event of a planned or unplanned shut-down, the coils can be actuated allowing the already heated process hardware (e.g., the production wing 50, the production choke 52, the flowline isolation valve block 54, and/or the flowspool 70) to maintain (or at least extend) their respective core temperatures, thereby avoiding the onset of hydrate formation. Once production recommences, the coils are turned off. That is, the operation of the coils may be controlled to be selectively activated and deactivated based on need (i.e., based on the occurrence of a shut-down event).

Figure 4:
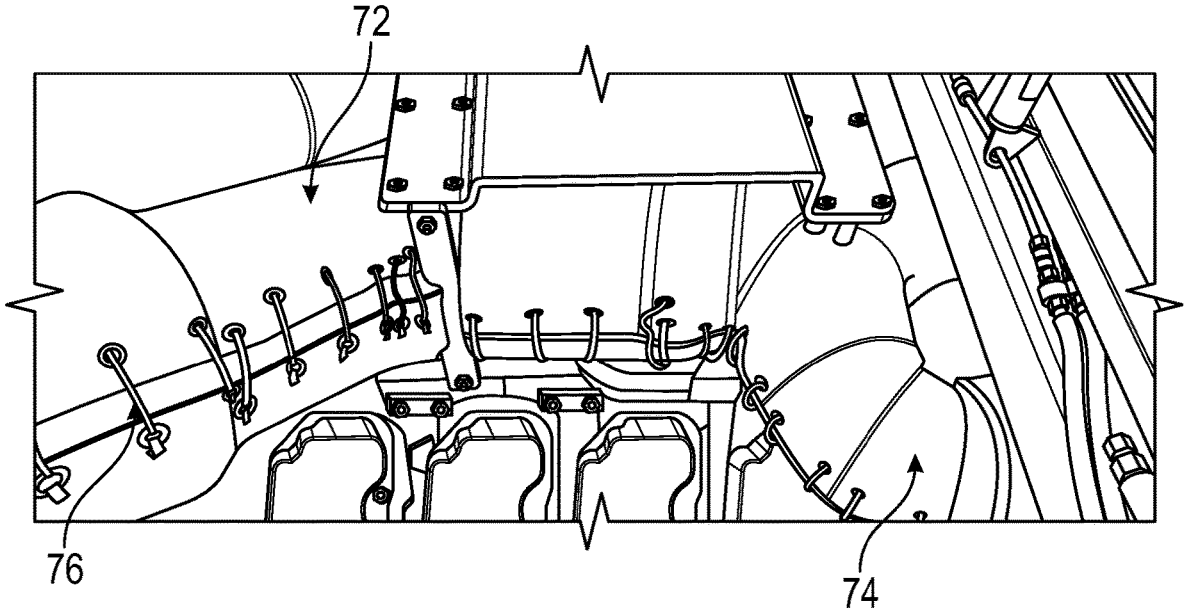
FIG. 4 is an illustration of a trace heating blanket, according to an embodiment of the present disclosure.

FIG. 4 illustrates an example of a trace heating blanket 72. In some embodiments, the trace heating blanket 72 can include the (heating) coils described above. The trace heating blanket 72 can include an exterior 74 with coils disposed therein. The exterior 74 may be made from a waterproof material, such as a waterproof polymer and may be flexible to allow the trace heating blanket 72 to be disposed about (e.g., wrapped around) hydrate-vulnerable elements of a subsea tree 14, e.g., region 62, region 64, region 66, region 68, etc. In some embodiments, one or more fasteners 76 can be utilized to couple one edge of the trace heating blanket 72 to an opposite edge of the trace heating blanket 72 when the trace heating blanket 72 is disposed about (e.g., wrapped around) hydrate vulnerable elements of a subsea tree 14. The one or more fasteners 76 can include one or more or adhesive strips, pins, belts, loops, hooks, cables, and the like. The one or more fasteners 76 can operate to secure the trace heating blanket 72 in position once it has been disposed about (e.g., wrapped around) hydrate vulnerable elements of a subsea tree 14.

In some embodiments, a single trace heating blanket 72 may be used to wrap the hydrate vulnerable elements of a subsea tree 14. In other embodiments, more than one trace heating blankets 72 may be used to wrap the hydrate vulnerable elements of a subsea tree 14. For example, respective trace heating blankets 72 can be employed to wrap the respective hydrate vulnerable elements of a subsea tree 14 or one hydrate vulnerable element of a subsea tree 14 can be wrapped using one trace heating blanket 72 and one or more additional hydrate vulnerable elements of a subsea tree 14 can be wrapped using one or more trace heating blankets 72. Thus, the trace heating blankets 72 can be provided in various shapes and/or sizes to suit the geometry of the subsea tree 14. For example, the blankets can be approximately, for example, 2 ft×2 ft (0.61 m×.61 m), 3 ft×3 ft (0.91 m×.91 m), 4 ft×4 ft (1.22 m×1.22 m), 5 ft×5 ft (1.52 m×1.52 m), 6 ft×6 ft (1.83 m×1.83 m), 2 ft×3 ft (0.61 m×.91 m), 2 ft×4 ft (0.61 m×1.22 m), 2 ft×5 ft (0.61 m×1.52 m), 2 ft×6 ft (0.61 m×1.83 m), 3 ft×4 ft (0.91 m×1.22 m), 3 ft×5 ft (0.91 m×1.52 m), 3 ft×6 ft (0.91 m×1.83 m), 4 ft×5 ft (1.22 m×1.52 m), 4 ft×6 ft (1.22 m×1.83 m), 5 ft×6 ft (1.52 m×1.83 m), 3 ft×2 ft (0.91 m×.61 m), 4 ft×2 ft (1.22 m×.61 m), 5 ft×2 ft (1.52 m×.61 m), 6 ft×2 ft (1.83 m×.61 m), 4 ft×3 ft (1.22 m×.91 m), 5 ft×3 ft (1.52 m×.91 m), 6 ft×3 ft (1.83 m×. 91 m), 5 ft×3 ft (1.52 m×.91 m), 5 ft×4 ft (1.52 m×1.22 m), 6 ft×5 ft (1.83 m×1.52 m), or another value. The blankets can instead be approximately, for example, 0.5 m×0.5 m, 1 m×1 m, 1.5 m×1.5 m, 2 m×2 m, 0.5 m×1 m, 0.5 m×1.5 m, 0.5 m×2 m, 1 m×0.5 m, 1 m×1.5 m, 1 m×2 m, 1.5 m×0.5 m, 1.5 m×1 m, 1.5 m×2 m, 2 m×0.5 m, 2 m×1 m, 2 m×1.5 m, or another value.

Figure 5:
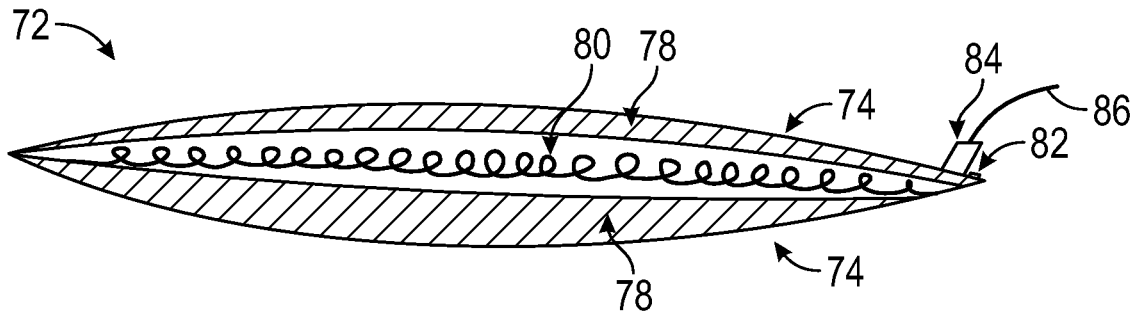
FIG. 5 illustrates a cross-sectional view of the trace heating blanket of FIG. 4, according to an embodiment of the present disclosure.

FIG. 5 illustrates a cross-sectional view of the trace heating blanket 72. As illustrated, the exterior 74 of the trace heating blanket 72 can be formed by sealing an upper exterior portion of the trace heating blanket 72 with a lower exterior portion of the trace heating blanket 72 to create a watertight area in which an insulation layer 78 (e.g., thermal insulation) and a layer of coils 80 can be disposed. As illustrated, the insulation layer 78 can be disposed both above and below the coils 80. Alternatively, the insulation layer 78 above the coils 80, below the coils 80, or both can be omitted from the trace heating blanket 72. For example, the insulation layer below the coils 80 can be omitted and the lower portion of the trace heating blanket 72 can be disposed adjacent to the hydrate vulnerable elements of a subsea tree 14, while the upper portion of the trace heating blanket 72 may contact the water (away from the hydrate vulnerable elements of the subsea tree 14). The coils 80 may be metal or other conductors and may operate to generate heat when power is applied thereto. In some embodiments, the power demand for the coils 80 (depending on the size of the respective trace heating blanket 72 in which they are disposed) can be, for example, approximately 200 W, 300 W, 400 W, 500 W, 600 W, 700 W, 800 W, 900 W, 1000 W, 1100 W, 1200 W, 1300 W, 1400 W, 1500 W, between approximately 200 W-300 W, 300 W-400 W, 400 W-500 W, 500 W-600 W, 600 W-700 W, 700 W-800 W, 800 W-900 W, 900 W-1000 W, 1000 W-1100 W, 1100 W-1200 W, 1200 W-1300 W, 1300 W-1400 W, 1400 W-1500 W, 200 W-400 W, 300 W-500 W, 400 W-600 W, 500 W-700 W, 600 W-800 W, 700 W-900 W, 800 W-1000 W, 900 W-1100 W, 1000 W-1200 W, 1100 W-1300 W, 1200 W-1400 W, 1300 W-1500 W, or another value. In some embodiments, the coils 80 can be powered for approximately, for example, 2 hours, 3 hours, 4 hours, 5 hours, 6 hours, 7 hours, 8 hours, approximately between 4 hours-6 hours, 5 hours-7 hours, 6 hours 8 hours, 4 hours-8 hours, or another value. The time that the coils 80 are active can correspond to the duration of the shut-down event.

The coils 80 can be powered via a power line 86 that can be coupled to the exterior 74 of the trace heating blanket 72. A waterproof connection 84 can be placed in the exterior 74 of the trace heating blanket 72 and a power connector 82 can be coupled to the waterproof connection 84. Alternate techniques to supply power to coils 80 can also be envisioned, for example, a power line that connects to the coils 80 and runs through a watertight port in the exterior of the trace heating blanket 72 for connection to a power supply separate from the trace heating blanket 72.

In some embodiments, the power supply can be a power supply on the subsea tree 14 used to power elements of the subsea tree during operation. The power supply can be coupled to the trace heating blanket 72 via, for example, the aforementioned power line from the trace heating blanket 72 or a power cable can be connected to the trace heating blanket 72, for example, at a connection on the trace heating blanket 72. In some embodiments, the subsea control system 56 can operate to selectively provide and disable power to the trace heating blanket 72 (or to a plurality of trace heating blankets 72 when more than one is employed to wrap hydrate vulnerable elements of a subsea tree 14).

Figure 6:
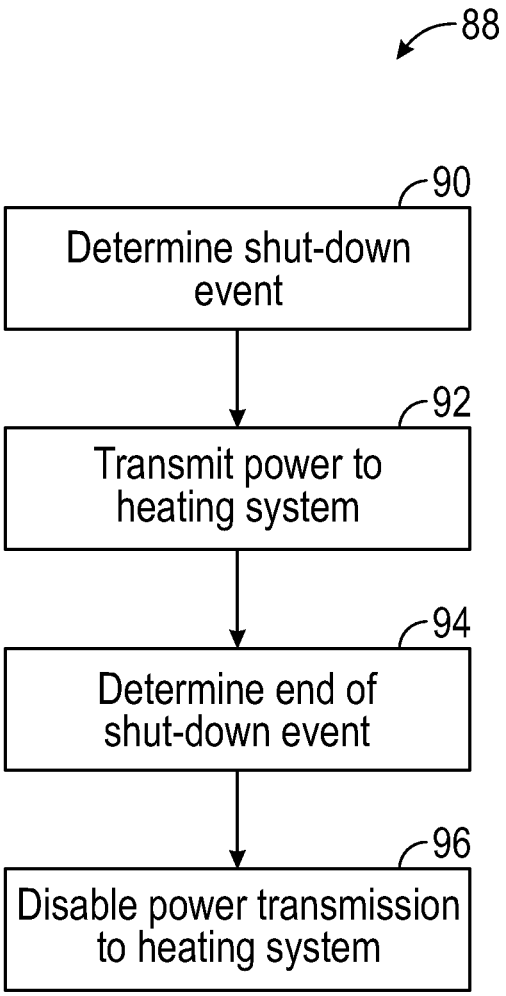
FIG. 6 is a flowchart of an example process for initiation of a heating mode of the trace heating blanket of FIG. 4, according to an embodiment of the present disclosure.

FIG. 6 illustrates a flow chart 88 that details a process for initiation and deactivation of a heating mode of the trace heating blanket 72. As noted above, this process can be applied to more than one trace heating blanket 72 when more than one trace heating blanket 72 is used to wrap hydrate vulnerable elements of a subsea tree 14. When more than one trace heating blanket 72 is utilized, the trace heating blankets can be connected in series and/or in parallel with a power supply. Moreover, it should be noted that one or more of the blocks of flow chart 88 may be performed by the one or more processors 58, for example, in conjunction with executing code stored in the memory 60 (and/or storage). Furthermore, blocks of the flow chart 88 need not necessarily be performed in the order recited and one or more blocks of the flow chart 88 can be omitted.

In block 90, a shut-down event can be identified. This can be accomplished via, for example, the subsea control system 56 either, for example, receiving a signal from one or more sensors indicating that a shut-down needs to be performed, receiving a signal from the surface that a shut-down operation is to occur, or determined by the subsea control system 56 itself. In block 92, the subsea control system 56 initiates powering of a heating system that can include one or more trace heating blankets 72. This can include, for example, closing of a switch to transmit power to the one or more trace heating blankets 72 or transmission of a signal to a power control unit that controls operation of a power source to activate the power source (e.g., when that power source is connected to one or more trace heating blankets 72 via, for example, a power cable). In a typical planned or unplanned shut-down, control of the subsea control system 56 is normally maintained allowing communication to surface. If the shut-down is a loss of communication (e.g., an umbilical failure), the controls of the heating feature described herein could be designed to be autonomously powered by a local power source, e.g., a battery pack, in place of or in an addition to an existing power supply of the subsea tree 14 (which can alternatively and/or additionally be used to power the one or more trace heating blankets 72). Furthermore, power to the one or more trace heating blankets 72 can be varied according to the temperature of the retained fluid/gas, which can be measured by sensors (e.g., sensors already in-place on the subsea tree 14.

In block 94, the end of the shut-down event can be identified. This can be accomplished via, for example, the subsea control system 56 either, for example, receiving a signal from one or more sensors indicating that a shut-down is complete, receiving a signal from the surface that a shut-down operation is complete, or determined by the subsea control system 56 itself. In block 96, the subsea control system 56 initiates disabling of powering of the heating system that can include one or more trace heating blankets 72. This can include, for example, opening of a switch to disable power transmission to the one or more trace heating blankets 72 or transmission of a signal to a power control unit that controls operation of a power source to deactivate the power source (e.g., when that power source is connected to one or more trace heating blankets 72 via, for example, a power cable).

The technical effect of the disclosed embodiments is to reduce or inhibit hydrate formation in an underwater environment and, more particularly, in underwater equipment, particularly a subsea tree 14. Localized low points (e.g., cold spots) can be elevated by heating in very specific areas of the subsea tree to avoid formation of the hydrates. Power to one or more trace heating blankets 72 can be selectively provided based on a determined shut-down event (and/or varied according to the temperature of the retained fluid/gas, measured by instrumentation of the subsea tree 14). Low power heating coils (e.g., coils 80) are distributed around the hydrate vulnerable elements of a subsea tree 14. In the event of a planned or unplanned shut-down the coils 80 are actuated allowing the already heated process hardware to maintain or at least extend the core temperature, thereby avoiding the onset of hydrate formation. Once production recommences, the coils 80 of the one or more trace heating blankets 72 are turned off. The one or more trace heating blankets 72 exhibit a relatively low current draw easily provided by either existing power supply and/or battery pack solutions.

The more typical solution of insulating the subsea tree 14 includes use of insulation material (typical glass syntactic polymers) in very high volume (e.g., 3 in—4 in thick) over the surface area of the subsea tree 14. These syntactics then require resistance to hyperbaric pressure and as such are difficult and expensive to engineer. This solution has a high carbon footprint and is typically only required in the limited durations of well shut-downs, typically hours or at most days over the life (e.g., 20 years) of a subsea tree 14. Likewise, remediation techniques if hydrates form is typically achieved with displacement of very high volumes of methanol, which again creates a very high carbon footprint. The present techniques allow for powering and use on an as-needed basis and, as such, power demand is near zero. This allows insulation raw material (polymers) to be eliminated, as well as eliminating the concern over long term disposal of polymers. Accordingly, the technical effect of the disclosed embodiments is both an environmental improvement and a protective measure for the underwater equipment.

The subject matter described in detail above may be defined by one or more clauses, as set forth below.

A system includes a subsea tree comprising an area susceptible to formation of hydrates when a shut-down of a well occurs and a trace heating blanket comprising an exterior layer and an interior layer comprising electric coils, wherein the trace heating blanket is disposed about the area of the subsea tree susceptible to formation of hydrates.

The system of the preceding clause, wherein the exterior layer further comprises a waterproof material.

The system of any preceding clause, wherein the trace heating blanket further comprises a waterproof connection disposed in the exterior layer of the trace heating blanket.

The system of any preceding clause, wherein the waterproof connection is coupled to the electric coils.

The system of any preceding clause, further comprising a power connector configured to be coupled to the waterproof connection to provide power to the electric coils.

The system of any preceding clause, wherein the subsea tree further comprises a power supply coupled to the power connector.

The system of any preceding clause, wherein the subsea tree further comprises a subsea control system coupled to the power supply, wherein the subsea control system is configured to selectively activate and deactivate the power supply.

The system of any preceding clause, further comprising a local battery pack configured to provide power via the power connector to the electric coils.

The system of any preceding clause, wherein the subsea tree further comprises a subsea control system coupled to the local battery pack, wherein the subsea control system is configured to selectively activate and deactivate the local battery pack.

The system of any preceding clause, wherein a trace heating blanket further comprises a second interior layer comprising an insulative material.

The system of any preceding clause, wherein the second interior layer is disposed between the electric coils and the exterior layer in a direction away from the area susceptible to formation of hydrates.

A system includes a subsea tree comprising an area susceptible to formation of hydrates when a shut-down of a well occurs and a subsea control system comprising a processor configured to determine an occurrence of the shut-down of the well. The system also includes a trace heating blanket comprising an exterior layer and an interior layer comprising electric coils, wherein the trace heating blanket is disposed about the area of the subsea tree susceptible to formation of hydrates.

The system of the preceding clause, further comprising a power supply coupled to the electric heating coils of the trace heating blanket.

The system of any preceding clause, wherein the processor is further configured to transmit an activation signal to the power supply to provide power to the electric heating coils of the trace heating blanket based upon determination of the occurrence of the shut-down of the well.

The system of any preceding clause, wherein the processor is further configured to determine an end of the occurrence of the shut-down of the well.

The system of any preceding clause, wherein the processor is further configured to transmit a deactivation signal to a power supply based upon determination of the end of the occurrence of the shut-down of the well.

A method includes determining an occurrence of a shut-down of a well and transmitting an activation signal to a power supply to provide power to electric heating coils of a trace heating blanket disposed about an area of a subsea tree susceptible to formation of hydrates based upon determination of the occurrence of the shut-down of the well.

The method of the preceding clause further comprising determining an end of the occurrence of the shut-down of the well.

The method of any preceding clause, further comprising transmitting a deactivation signal to the power supply based upon determination of the end of the occurrence of the shut-down of the well.

The method of any preceding clause, wherein the determining of the occurrence of the shut-down of a well is based upon one or more signals received from at least one sensor of the subsea tree.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform] ing [a function] . . . " or "step for [perform] ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A system comprising:

a subsea tree comprising an area susceptible to formation of hydrates when a shut-down of a well occurs; and a trace heating blanket comprising an exterior layer and an interior layer comprising electric coils, wherein the trace heating blanket is flexible to allow the trace heating blanket to be wrapped around the area of the subsea tree susceptible to formation of hydrates, securable in position about the area via a fastener coupling a first portion of the trace heating blanket to a second portion of the trace heating blanket, and removable from the position about the area upon removal of the fastener.

2. The system of claim 1, wherein the exterior layer further comprises a waterproof material.

3. The system of claim 1, wherein the trace heating blanket further comprises a waterproof connection disposed in the exterior layer of the trace heating blanket.

4. The system of claim 3, wherein the waterproof connection is coupled to the electric coils.

5. The system of claim 4, further comprising a power connector configured to couple to the waterproof connection to provide power to the electric coils.

6. The system of claim 5, wherein the subsea tree further comprises a power supply coupled to the power connector.

7. The system of claim 6, wherein the subsea tree further comprises a subsea control system coupled to the power supply, wherein the subsea control system is configured to selectively activate and deactivate the power supply.

8. The system of claim 5, further comprising a local battery pack configured to provide power via the power connector to the electric coils.

9. The system of claim 8, wherein the subsea tree further comprises a subsea control system coupled to the local battery pack, wherein the subsea control system is configured to selectively activate and deactivate the local battery pack.

10. The system of claim 1, wherein the trace heating blanket further comprises a second interior layer comprising an insulative material.

11. The system of claim 10, wherein the second interior layer is disposed between the electric coils and the exterior layer in a direction away from the area susceptible to formation of hydrates.

12. A system comprising:

a subsea tree comprising:

an area susceptible to formation of hydrates when a shut-down of a well occurs; and a subsea control system comprising a processor configured to determine an occurrence of the shut-down of the well; and a trace heating blanket comprising an exterior layer and an interior layer comprising electric coils, wherein the trace heating blanket is flexible to allow the trace heating blanket to be wrapped around the area of the subsea tree susceptible to formation of hydrates, securable in position about the area via a fastener coupling a first portion of the trace heating blanket to a second portion of the trace heating blanket, and removable from the position about the area upon removal of the fastener.

13. The system of claim 12, further comprising a power supply coupled to the electric coils of the trace heating blanket.

14. The system of claim 13, wherein the processor is further configured to transmit an activation signal to the power supply to provide power to the electric coils of the trace heating blanket based upon determination of the occurrence of the shut-down of the well.

15. The system of claim 14, wherein the processor is further configured to determine an end of the occurrence of the shut-down of the well.

16. The system of claim 15, wherein the processor is further configured to transmit a deactivation signal to the power supply based upon determination of the end of the occurrence of the shut-down of the well.

17. A method comprising:

determining an occurrence of a shut-down of a well; and transmitting an activation signal to a power supply to provide power to electric coils of a trace heating blanket disposed about an area of a subsea tree susceptible to formation of hydrates based upon determination of the occurrence of the shut-down of the well, wherein the trace heating blanket is flexible to allow the trace heating blanket to be wrapped around the area of the subsea tree, securable in position about the area via a fastener coupling a first portion of the trace heating blanket to a second portion of the trace heating blanket, and removable from the position about the area upon removal of the fastener.

18. The method of claim 17, further comprising determining an end of the occurrence of the shut-down of the well.

19. The method of claim 18, further comprising transmitting a deactivation signal to the power supply based upon determination of the end of the occurrence of the shut-down of the well.

20. The method of claim 17, wherein the determining of the occurrence of the shut-down of the well is based upon one or more signals received from at least one sensor of the subsea tree.

* * * * *